US006323449B1

(12) United States Patent
Janniere

(10) Patent No.: US 6,323,449 B1
(45) Date of Patent: Nov. 27, 2001

(54) TOUCH SENSITIVE MULTIPLE ELECTRICAL SWITCH

(75) Inventor: Alain Janniere, Paris (FR)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 09/568,869

(22) Filed: May 9, 2000

(51) Int. Cl.[7] ..... H01H 13/52; H01H 1/24; H01H 13/12; H01H 13/48

(52) U.S. Cl. ..... 200/408; 200/406; 200/317

(58) Field of Search ..... 200/3 A, 402–412, 200/512–517

(56) References Cited

U.S. PATENT DOCUMENTS

| | | | | |
|---|---|---|---|---|
| 4,032,728 | * | 6/1977 | Oelsch | 200/5 A |
| 4,385,218 | * | 5/1983 | Nishida | 200/406 |
| 4,405,845 | * | 9/1983 | Kondo et al. | 200/408 |
| 4,588,877 | * | 5/1986 | Mizuta et al. | 200/406 |
| 4,931,605 | * | 6/1990 | Zoller | 200/408 |
| 5,660,272 | * | 8/1997 | Janniere et al. | 200/517 |
| 6,018,132 | * | 1/2001 | Chen | 200/406 |
| 6,180,903 | * | 1/2001 | Chen | 200/406 |

FOREIGN PATENT DOCUMENTS

| | | | |
|---|---|---|---|
| 3137749A1 | | 1/1983 | (DE) . |
| 0339151A1 | | 11/1989 | (EP) . |
| 0743663A1 | | 11/1996 | (EP) . |
| WO 99/28937 | * | 6/1999 | (WO) . |

* cited by examiner

*Primary Examiner*—J. R. Scott
(74) *Attorney, Agent, or Firm*—Roger C. Turner

(57) ABSTRACT

An electrical switch is provided, which is of low height and which uses a single snap dome tripper (36) to close a plurality of switch devices and provide tactile feedback to the person who has depressed the tripper. The switch includes a support (12), a plurality of contacts (26) mounted on the support with each contact having an exposed engaging surface in the lower portion of the support. An intermediate contact member in the form of a plate (44), lies over the engaging surfaces of the contacts, and the snap dome tripper lies over the intermediate contact member. The intermediate contact member has a plurality of blades (50) that are each downwardly deflected against a corresponding engaging surface (29) when the tripper is depressed.

14 Claims, 2 Drawing Sheets

TOUCH SENSITIVE MULTIPLE ELECTRICAL SWITCH

CROSS-REFERENCE

Applicant claims priority from French patent application No. 97/14990 filed Nov. 28, 1997 and PCT application PCT/FR98/02480 filed Nov. 18, 1998 which named the United States.

BACKGROUND OF THE INVENTION

One type of electrical switch includes electrically conductive blades that can be deflected down against contacts to close switches formed by the blades and contacts. An actuator that downwardly deflects the blades can include a snap dome tripper which suddenly snaps down when deflected past a transition point. The sudden change of state of the tripper provides a tactile feedback to the person who depresses the switch, to inform him/her that the switch has been closed so the person will not press with greater force on the push button.

Many products are being manufactured in progressively smaller sizes, and it is desirable to provide a switch with multiple contacts, which is of small size, and especially very small thickness. The switch and other components are commonly mounted on a circuit board, and the switch should take up little space on the circuit board and project a minimal distance above it. It is also desirable to reduce the number of components required for a switch, and to incorporate two or more different switch devices into a single switch. A single switch that has a minimum number of easily assembled components, in which operation of the switch as by depressing an actuator, results in the closing of many switch devices, which creates a tactile feedback through the actuator, which has a small size and especially a very small thickness, and which uses a minimum number of components, would be of value.

SUMMARY OF THE INVENTION

In accordance with one embodiment of the present invention, applicant provides an electrical switch with a plurality of switch devices that are all operated by operation of a single actuator, and with tactile feedback through the actuator, where the switch is of very small size and has a minimum number of components. The switch includes a support with a dielectric lower portion, a plurality of contacts mounted on the support and having exposed contact surfaces at the support lower portion, an intermediate contact member that is largely in the form of a plate lying above the contact surfaces, and a tripper which lies above the intermediate contact member. The largely plate-shaped intermediate contact member has slots forming a plurality of blades that are each positioned over but spaced from the contact surfaces so the blades can be deflected against the contact surfaces. The tripper is of the snap dome type that snaps down to downwardly deflect the leaves of the intermediate contact member against the contact surfaces when the tripper has been depressed more than a predetermined amount so it then snaps down.

The snap dome tripper preferably lies directly on the intermediate member, which minimizes the height of the switch and the number of switch components. The exposed contact surfaces are preferably flush with a dielectric flat surface at the lower portion of the support. The contacts lie at opposite sides of the middle of the dielectric surface. This allows the middle of the snap dome tripper to deflect very close to the dielectric support surface.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
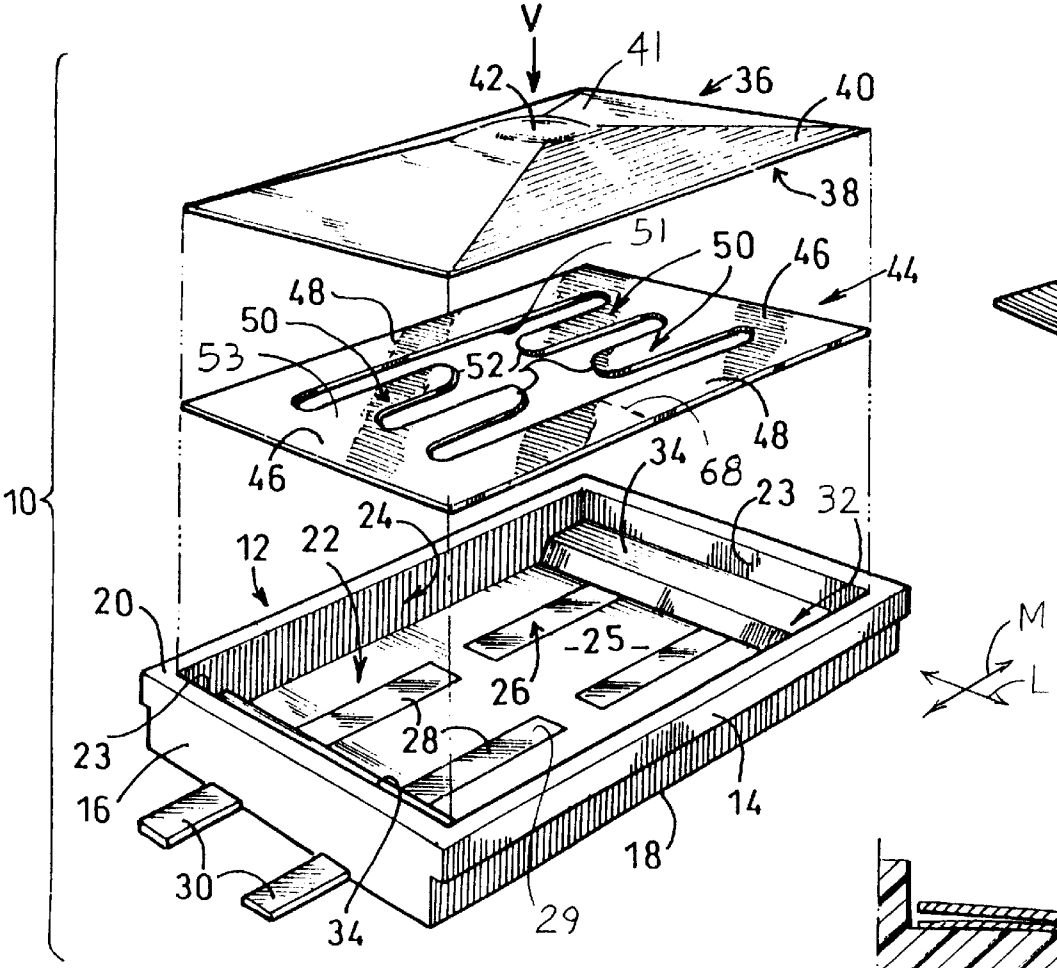
FIG. 1 is an exploded isometric view of switch of the invention.

FIG. 1 illustrates an electrical switch assembly or switch 10 which includes a body or support 12 that is molded of dielectric plastic and that is of generally rectangular shape as seen in a plan view, with a longer length in longitudinal M directions than in perpendicular lateral L directions. The support has laterally opposite sides 14 and longitudinally opposite ends, and has lower and upper faces 18, 20 with the upper face being open. The support forms an upwardly-opening cavity 22 having a bottom 25 and side walls 24. The support is produced by overmolding it onto four fixed conducting elements or contacts 26. The switch also includes an intermediate contact member or contact plate 44 that rests on raised areas or platforms 32 of the support, and a snap dome tripper 36 that lies over the contact plate 44.

Figure 2:
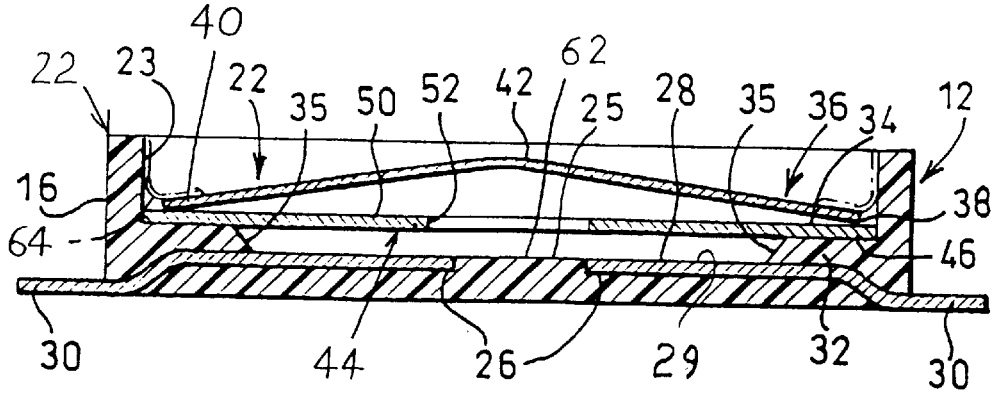
FIG. 2 is a sectional view taken on line 2—2 of FIG. 4, which shows the switch in its initial and open state, rest state.

As shown in FIG. 2, each contact 26 includes a metal strip that is bent, with an inner end 28 that forms an upwardly-exposed contact surface 29, and with an outer end 30 projecting outside the housing and adapted for surface soldering to traces on a circuit board. The upper contact surface 29 of the contact inner ends are flush with the flat bottom 25 of the support.

The contact plate 44 is formed from a piece of sheet metal. As shown in FIG. 1, the contact plate has a slot or connected slots 51 that leaves four leaves or blades 50 and a peripheral portion to form the rest of the plate. Each blade has an inner end 53 that merges with the rest of the plate, and has a free outer end 52. Each blade corresponds to one of the contacts, and each combination of a blade and a contact can be referred to as a switch device. It is noted that the peripheral portion of contact plate has longitudinally spaced edge portions 46 and laterally spaced edge portions 48 that form a one-piece continuous piece of sheet metal that is integral with the four blades. The contact plate is mounted on the support by laying its longitudinal edge portions 46 on bearing surfaces 34 at the upper ends of the platforms 32 of the support lower portion. FIG. 2 shows the contact plate 44 lying on the platforms 32, with the blade free ends 52 vertically spaced from the contact surfaces 29.

The tripper 36 which has a largely pyramid shape, is often referred to as a "snap dome" in that it has the action of a sheet metal dome which, when the center is depressed more than a predetermined amount, suddenly snaps downward and creates a tactile feedback resulting from the snap action. As shown in FIG. 1, the tripper has a largely rectangular periphery 38 of a shape largely corresponding to the largely rectangular shape of the contact plate 44 and the largely rectangular shape of the support cavity 22. The tripper has a lower base portion 40 which is fixed, a central portion 41 which deflects, and a central part 42 at the center of the central portion, which is the part that deflects the greatest amount, and which is the part that is usually depressed, as in the direction of the downward arrow V. FIG. 2 shows the tripper in position with its lower base portion lying on a peripheral portion 46 of the contact plate. It is possible to place a thin film between them without substantially increasing the height of the switch.

Figure 3:
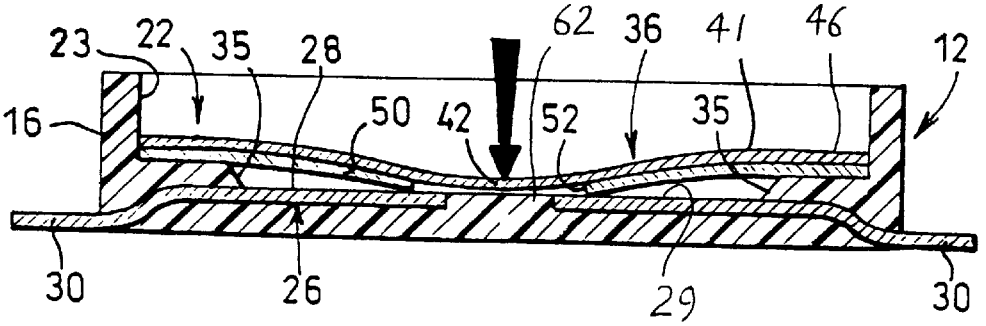
FIG. 3 is a view similar to that of FIG. 2, but with the switch in an activated or closed state with the tripper and intermediate contact member downwardly deflected.
Figure 4:
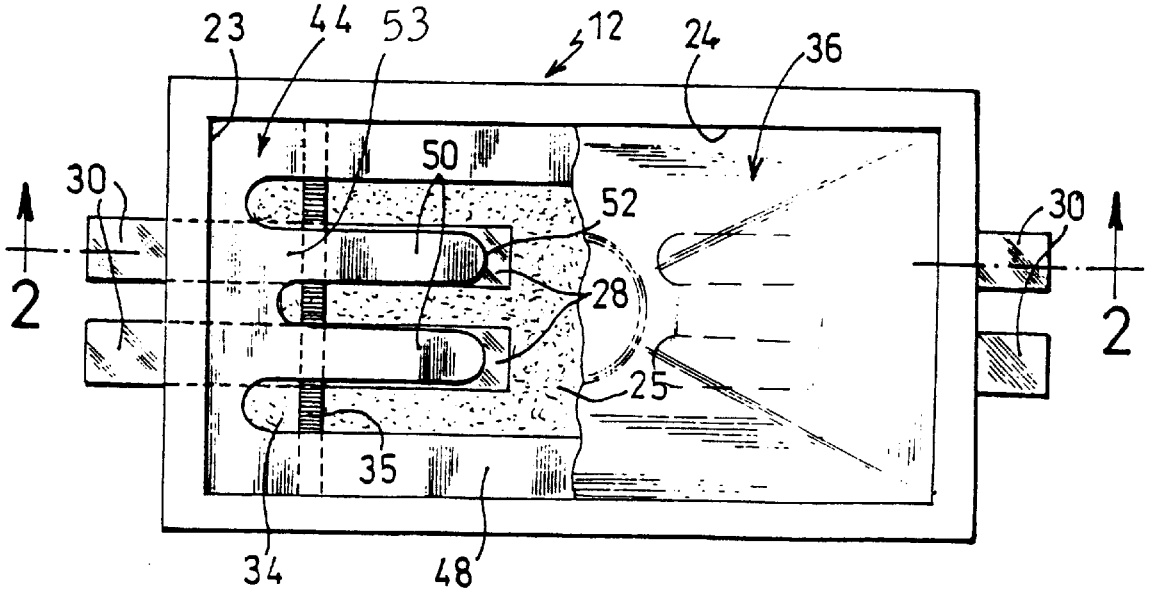
FIG. 4 is a plan view of the switch of FIG. 2, with the tripper partially cut away.

FIG. 3 shows the switch after the central part 42 of the tripper has been depressed, and has snapped downward to its fully deflected position. During its sudden downward travel, the central portion 41 of the tripper, which is the portion inside the periphery 46, presses downward against the blades 50 and deflects them downward so their free ends 52 firmly engage the contact surfaces 29 of the fixed contacts. During the end of travel of the tripper 36, the four contact blades 50 are brought almost simultaneously into electrical contact with each of the fixed contacts 26.

In one situation where the switch can be used, the four contacts 26 are each connected to one end of each of four different circuits, with the other end of each of the four circuits connected to the contact plate 44. When the four blades 50 are downwardly deflected against the four contacts 26, the opposite ends of each circuit are connected together and to a common potential, which may be ground potential, at which the contact plate 44 is established.

In FIG. 2, it can be seen that the ends of the contact upper surfaces 29 are spaced from a center region 62 of the support bottom wall 25. In FIG. 3, when the tripper center part 42 is fully depressed, it lies against or close to the center region 62. The free ends 52 of the blades on the contact plate, are not directly above the center region 62, and therefore allow further downward travel of the central part 42 of the tripper. It may be noted that the platforms 32 which support portions 46 of the contact plate, have champhers at 35 that avoid interference with downward deflection of the blades of the contact plate.

While the four contacts 26 and the contact plate 44 are both formed of electrically conductive material, preferably sheet metal, the tripper 36 can be formed of either metal such as sheet metal or a dielectric polymer. If the tripper is to be directly depressed by a person's finger, then there is an advantage in making the tripper of insulative material such as plastic, in that no currents pass to the finger of the person who depresses the tripper. In that case, a seal and holddown can be provided by a film as indicated at 64 in FIG. 2, that extends around the entire periphery of the tripper and the inside walls of the support. In some applications, a separate plunger, which may be depressed by a person's finger, depresses the central part 42 of the tripper.

Figure 5:
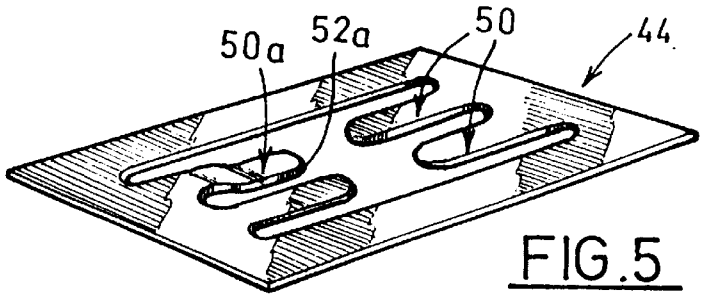
FIG. 5 is an isometric view of a contact plate of another embodiment of the invention, wherein one of the blades is permanently downwardly deformed.
Figure 6:
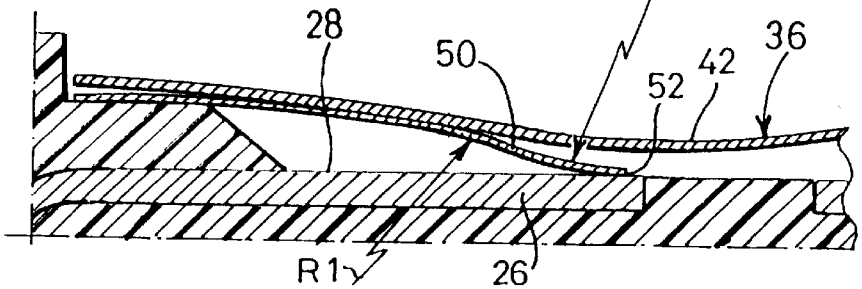
FIG. 6 is an enlarged sectional view of a switch that includes the contact plate of FIG. 5, and with the tripper having been depressed.

FIGS. 5 and 6 illustrate another embodiment of the invention, in which one of the four blades, designated 50*a*, is permanently deformed so its free end 52*a* is in constant engagement with one of the contacts 26. The advantage of having one downwardly-deformed blade 50*a* on the contact plate, is that the contact that is engaged by the blade 50*a* engages, can be grounded, to thereby simplify grounding of the contact plate 44. Otherwise, other means such as providing a tail on the contact blade that extends down to a circuit board to be soldered thereto, may be required.

FIG. 6 illustrates the deformation of an ordinary contact plate, before the end of downward travel of the tripper 36. It is noted that the blade 50 undergoes an S-shaped deflection, with its outer end portion having a concave upper surface with a radius of curvature R2, and with the blade inner portion having a lower surface that is concave at a radius of curvature R1. The two opposed radii of curvature avoid instability of a contact that could otherwise result from the tripper 36 deflecting downwardly more or less than shown in FIG. 3. The concave upper surface near the free end 52 of the blade results from the extreme free end being prevented from moving down any further, while the inner portion of the blade is still being moved downward.

Although the figures show a switch of rectangular general outline, the invention can be applied to a switch with a domed disk tripper, with the contact plate then preferably having a circular periphery. The contact blades then can extend radially toward the center of the switch, although they also can extend in the same manner as shown in FIG. 1. It is also possible to "cut" the contact plate 44 shown in FIG. 1 along an imaginary line 68 to isolate blades at longitudinally opposite ends of the two-piece contact plate.

While terms such as "upper", "lower", etc. have been used in describing the invention as illustrated, it should be understood that it is possible to use the switch in any orientation with respect to the Earth.

Thus, the invention provides an electrical switch which includes a plurality of contacts mounted on a support, a contact plate having blades that can be deflected down against contact surfaces of the contacts, and a tripper of the type that snaps down, to downwardly deflect the blades against the contact surfaces. The contact surfaces are preferably flat and largely flush with a flat lower surface of the support. The tripper has a periphery that preferably lies directly on the contact plate to minimize the vertical height of the switch. The blades of the contact plate are preferably straight between their inner ends that merge with the rest of the plate and their outer ends, to avoid twisting of the blades. With the contacts molded into the support, the switch has only three parts to be assembled and add to the height of the switch, these being the support with molded-in contacts, the contact plate that lies on the surfaces of the support, and a tripper that lies directly (with no more than a film between it and the contact plate) on the contact plate.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An electrical switch, comprising:

a dielectric support;

a plurality of electrically conductive contacts mounted on said support, with each contact having an inner portion with an upwardly-exposed contact surface;

an intermediate contact member that forms a plurality of resilient blades positioned over and spaced from said contact surfaces to be deflected directly against said contact surfaces;

a tripper which has a peripheral portion and a center portion, said tripper lying above said resilient blades and said tripper constructed so said center portion snaps down when said center portion is downwardly deflected more than a predetermined amount, with said center portion positioned to directly engage and downwardly deflect said resilient blades against said contact surfaces.

2. The switch described in claim 1 wherein:

said intermediate contact member includes a plate portion, and said resilient blades are in the form of straight strips with inner ends merging with the rest of said plate portion and with free outer ends.

3. The switch described in claim 1 wherein:

said support lower portion has a flat center area, and said contact surfaces are substantially flush and coplanar with said flat center area.

4. The switch described in claim 1 wherein:

said support lower portion forms a cavity with a floor, with said inner contact portions lying on said floor, said cavity having a raised periphery forming at least one platform and lying above said floor;

said contact member has a periphery lying on said raised periphery of said support;

said tripper has a peripheral portion that lies directly on said contact member.

5. The switch described in claim 1 wherein:

said contact member has a slot forming an elongated resilient arm that is permanently bent to extend downward and which has a free lower end that permanently engages one of said contact surfaces.

6. An electrical switch comprising:

a dielectric support having a bottom wall;

a plurality of contacts with upwardly-exposed contact surfaces lying on said bottom wall;

a contact member with a largely plate portion having slots forming a plurality of resilient blades that each lies over one of said contact surfaces, with said contact member having a periphery supported on said support, and with said blades each spaced from a corresponding contact surface;

a tripper which lies over said blades of said contact plate and which has a center portion that snaps down when downwardly deflected more than a predetermined amount, to deflect said blades against said contact surfaces.

7. The switch described in claim 6 wherein:

said bottom wall of said support is substantially flat and has a periphery and has a middle part located at the middle of said periphery;

said contact surfaces are substantially flush with said bottom wall, with said resilient blades having free ends and with said contact surfaces and said blade free ends not lying over said middle part of said bottom wall;

said tripper center portion has a middle part that lies over said middle part of said bottom wall, so said middle part of said tripper can closely approach said middle part of said bottom wall when said tripper center portion snaps down.

8. The switch described in claim 6 wherein:

said tripper has a periphery that lies directly on said intermediate contact member.

9. The switch described in claim 6 wherein:

said bottom wall is substantially rectangular and said support has a periphery extending up from the periphery of said bottom wall;

said contact member has a substantially rectangular periphery with laterally opposite sides and longitudinally spaced opposite ends, and said contact member has a slot that leaves a continuous peripheral portion;

two of said resilient blades extend longitudinally from a first of said longitudinally spaced ends of said contact member periphery toward a second of said opposite ends, and a least a third of said resilient blades extends from said second end of said contact member periphery toward said first end.

10. An electrical switch, comprising:

a dielectric support;

a plurality of electrically conductive contacts mounted on said support, with each contact having an inner portion with an upwardly-exposed contact surface;

a plurality of resilient blades with inner ends lying at a fixed position with respect to said support and with free outer ends lying over and spaced from said contact surfaces to be deflected directly against said contact surfaces;

a tripper which has a peripheral portion and a center portion, said tripper lying above said resilient blades and said tripper constructed so said center portion snaps down when said center portion is downwardly deflected more than a predetermined amount, with said center portion positioned to directly engage and downwardly deflect said resilient blades against said contact surfaces.

11. The switch described in claim 10 including:

a plate portion with slots forming said resilient blades, with said resilient blades being in the form of straight strips with said inner ends merging with the rest of said plate portion.

12. The switch described in claim 10 wherein:

said support lower portion has a flat center area, and said contact surfaces are substantially flush and coplanar with said flat center area.

13. An electrical switch, comprising:

a dielectric support;

a plurality of electrically conductive contacts mounted on said support, with each contact having an inner portion with an upwardly-exposed contact surface;

a sheet metal contact member mounted on said support and having a largely plate-like portion with slots forming a plurality of blades with inner ends merging with said largely plate-like portion and with free outer ends lying over and spaced from said contact surfaces to be deflected directly against said contact surfaces;

a tripper which has a peripheral portion and a center portion, said tripper lying above said largely plate-like portion and said tripper constructed so said center portion snaps down when said center portion is downwardly deflected more than a predetermined amount, with said center portion positioned to directly engage said largely plate-like portion to downwardly deflect said blades against said contact surfaces.

14. The switch described in claim 10 wherein:

said support lower portion has a flat center area, and said contact surfaces are substantially flush and coplanar with said flat center area.

* * * * *